United States Patent [19]

Koboshi et al.

[11] Patent Number: 4,814,260

[45] Date of Patent: Mar. 21, 1989

[54] METHOD OF STORING PHOTOGRAPHIC PROCESSING SOLUTION IN A PACKAGE HAVING SPECIFIC OXYGEN PERMEABILITY

[75] Inventors: Shigeharu Koboshi; Kazuyoshi Miyaoka; Masahiko Kon, all of Tokyo, Japan

[73] Assignee: Konishiroku Photo Industry Co., Ltd., Tokyo, Japan

[21] Appl. No.: 62,871

[22] Filed: Jun. 16, 1987

[30] Foreign Application Priority Data

Jun. 20, 1986 [JP] Japan ..... 61-142818
Jun. 20, 1986 [JP] Japan ..... 61-142819

[51] Int. Cl.[4] ..... G03C 3/00; G03C 5/24; G03C 5/42; G03C 5/44

[52] U.S. Cl. ..... 430/464; 430/264; 430/393; 430/430; 430/460; 430/468; 430/485; 430/490; 430/491; 430/495; 430/496; 430/497; 430/542

[58] Field of Search ..... 430/393, 430, 485, 486, 430/462, 466, 496, 495, 497, 542, 264, 464; 206/594.5

[56] References Cited

U.S. PATENT DOCUMENTS 4,263,397 4/1981 Horikoshi et al. ..... 430/542
4,283,486 8/1981 Aono et al. ..... 430/372
4,303,750 1/1981 Campbell et al. ..... 206/524.5
4,303,751 1/1981 Campbell et al. ..... 206/524.5
4,554,242 11/1985 Ohno et al. ..... 430/393
4,565,775 1/1986 Forte ..... 430/393
4,601,975 7/1986 Koboshi et al. ..... 430/393

FOREIGN PATENT DOCUMENTS 1156868 11/1985 Canada .

*Primary Examiner*—Mukund J. Shah
*Attorney, Agent, or Firm*—Jordan B. Bierman

[57] ABSTRACT

A method of storing a liquid color developer and a liquid bleach-fixer in a container made of plastic material having an oxygen permeation coefficient of 0 to 50 m/(m$^2$ atm day) at temperatures of 20° C. and relative humidity of 60%. The developer contains an aromatic primary amine color developing agent; a hydroxylamine of the formula wherein $R^1$ and $R^2$ are hydrogen or alkyl having 1 to 3 carbon atoms, provided that at least one of $R^1$ and $R^2$ is an unsubstituted alkyl group having 1 to 3 carbon atoms and that $R^1$ and $R^2$ may be combined with each other to form a ring; and an alkaline ingredient for adjusting the pH of the developer to not less than 9.5. The bleach-fixer contains a ferric aminopolycarboxylate, 0 to $1\times10^{-3}$ mols per liter of an aminopolycarboxylic acid based on the total bleach-fixer, a thiosulfate, and $1\times10^{-3}$ to $2\times10^{-1}$ mol per liter of said liquid bleach-fixer of a sulfite.

31 Claims, 1 Drawing Sheet

METHOD OF STORING PHOTOGRAPHIC PROCESSING SOLUTION IN A PACKAGE HAVING SPECIFIC OXYGEN PERMEABILITY

BACKGROUND OF THE INVENTION

The present invention relates to a method of storing photographic processing solutions used for treating silver halide photographic light-sensitive materials of color photography, and more specifically to a method to store color developer as well as bleach-fixer without deteriorating the properties of such processing solutions.

Generally, forming a photographic image inevitably accompanies a process to form a negative or positive image by treating a silver halide photographic light-sensitive material already bearing a latent image in such processing steps as developing, fixing and the like. With a silver halide photographic light-sensitive material for color photography, a negative or positive color image is formed via such processes as color developing, bleach-fixing (in some cases, bleaching and fixing are independently carried out), washing and others.

Treating silver halide photographic light-sensitive materials in such processes has been conventionally exercised in photofinishing laboratories, known as large-scale laboratory systems having large-scale facilities and equipment. Recently however, the chances are increasing for less experienced people, or so-called "amateurs", to process silver halide photographic light-sensitive materials, as the so-called mini-laboratory systems for private use, which allow easy processing even in individual camera shops, business offices and the like, have been developed and marketed. Developing and bleach-fixing the silver halide photographic light-sensitive materials for color photography requires color developer and bleach-fixer. In such processing steps for the so-called mini-laboratory system for private use, these processing solutions should be readily-usable types having incorporated specific ingredients, because an operator is a so-called "amateur".

However, the conventional color developer comprises contents working as oxidizing agents as well as those working as reducing agents. Accordingly, such a developer has disadvantages: its properties tend to deteriorate due to internal redox reaction during storage; reductive materials in it tends to degrade due to oxidation with air. As a result, the long-term storage of the similar developer is disadvantageously difficult.

As a useful bleach-fixer, those composed of ferric aminocarboxylate and thiosulfate have been conventionally known in the art. However, such a bleach-fixer has a problem; because ferric aminocarboxylate functions as an oxidizing agent, and thiosulfate functions as a reducing agent, the thiosulfate is decomposed in oxidation by the ferric aminocarboxylate during the course of storing the bleach-fixer, generating sulfur, and, consequently, the properties of the bleach-fixer deteriorates as the sulfur precipitates.

Therefore, an arrangement to incorporate sulfite, as a preservative to inhibit oxidation-decomposition of thiosulfate, into a bleach-fixer is exercised. Sulfite, however, is readily decomposed by oxygen in air, and is readily oxidized with the ferric aminocarboxylate. Accordingly, the proportion of sulfite gradually decreaes in the course of storage of bleach-fixer, and the sulfite gradually fails to fully provide its performance as a preservative, thus, making the long-term preservation of bleach-fixer difficult.

Accordingly, the color developer and the bleach-fixer have been supplied to users in compliance with the following means (1) A supplying means, whereby each of such processing solutions prepared by experts in the photofinishing laboratories known as large-scale laboratory systems is supplied in a small quantity to a user immediately before the actual use.

(2) A supplying means, whereby each of such processing solutions is supplied to a user, in the form of a kit comprising packages each containing a pack of each ingredient.

With a means in (1), above, however, it is significantly difficult to swiftly and smoothly deliver necessary amounts of the prepared processing solutions, above, to a user immediately before the actual use, because a user operating a mini-laboratory system does not know either when the order for photographic processing will come, nor how large is the size of order, or, even worse, the user may fail to produce photographs within a period in compliance with an order from a client, because of the delay in supply of the above-mentioned processing solutions. On the other hand, it seems possible to order rather larger amounts of such processing solutions in advance, by estimating necessary amounts. Such a precaution, however, disadvantageously causes the deterioration of properties for the above-mentioned processing solutions.

The means in (2), above, involves many ingredients which must be prepared, and also requires a procedure to dissolve the ingredients into a solvent. Furthermore, in this procedure, it is usually mandatory to start dissolving one ingredient after another ingredient has been completely dissolved. This indicates one must wait, with continuous stirring, for several to scores of minutes before one can start dissolving another ingredient, and, therefore, requires considerable amount of time and labor. Since an operator who operates a mini-laboratory system for private use, installed in a camera shop, business office or the like, is usually a layman in photographic processing, he/she has a difficulty in identifying ingredients separately packed, and may incorrectly prepare the above-mentioned processing solutions, and therefore may fail to prepare the above-mentioned processing solutions, that is, color developer and bleach-fixer respectively having adequate photographic performance.

For this reason, the inventors have devoted themselves in the study of a container which stores color developer or bleach-fixer free from the property deterioration of such a processing solution.

As a one means for this purpose, it is possible to store a color developer in a sealed container comprising a plastic packing material having extremely low permeability to oxygen, so as to prevent this processing solution from being deteriorated in properties by oxidation.

A color developer, however, conventionally contains a preservative, such as a hydroxylamine, or a sulfate or hydrochloride thereof, which prevents the oxidation by air and inhibits redox reaction among ingredients. Such a hydroxylamine readily decomposes in an alkali solution, and readily emits ammonia gas and nitrogen gas, causing various problems: the color developer may fail to fully provide its photographic performance; the nitrogen gas filled in a sealed container may break a seal of a plastic packing material, leaking the color developer, or may break an outlet or inlet for color developer provided on the container.

In contrast, it is possible to diffuse nitrogen gas generated in a container composed of a plastic packing material through which nitrogen gas can readily permeate. This arrangement however invites another problem; oxygen gas permeates into the container, causing the color developer to deteriorate due to oxidation.

Additionally, a means was already proposed, wherein generation of nitrogen gas is inhibited by storing a color developer in the form of condensed paste, and during a developing process the developer is taken out of the container in a specific amount which is automatically dissolved into water (see the specifications of PCT-designated Japanese Patent Publications Nos. 500487/1982 and 500485/1982).

Such a technical means, however, poses a problem; being stored in a container in the form of condensed paste, the color developer tends to be highly alkali, and is readily air-oxidized, and, its properties prematurely deteriorate due to a redox reaction.

Consequently, in practice, a color developing agent, a preservative comprising hydroxylamine, and an alkali agent are necessarily stored in independent packs. Accordingly, a user himself/herself must blend the ingredients to prepare a color developer before carrying out developing process.

Though being excellent in the performance, as a preservative, an unsubstituted hydroxylamine, or a sulfate thereof, has a strong toxity, and has a large probability to adversely affect human body or the like when a user handles a color developer in a mini-laboratory system for the private use.

The method of storing a color developer, wherein a color developer not requiring a procedure to blend the necessary ingredient and being safe in handling because having small toxity is stably stored for a longer period, has not yet found.

In the case of a bleach-fixer, it seems possible to store the bleach fixer being sealed in a container comprising a plastic packing material having an extremely low oxygen-permeability, so as to prevent the property deterioration of the bleach-fixer due to air-oxidation.

However, despite such arrangement, the oxidation of sulfite in the bleach-fixer processed due to a trifle amount of oxygen permeating through the container, and the oxidation further proceeds by ferric aminocarboxylate in the bleach-fixer As a result, the sulfide fails to fully provide its performance as a preservative, triggering the oxygenic decomposition of thiosulfate, which lowers the performance of the bleach-fixer. Additionally, the oxidation of sulfite in bleach-fixer by ferric aminocarboxylate generates ferrous aminocarboxylate as a reduction product of the ferric aminocarboxylate generates, and the cumulative ferrous aminocarboxylate disadvantageously causes so-called poor recoloration, wherein a dye is made into a leuco material which has a color different from that of the dye.

As can be understood from the description, above, storing a bleach-fixer for a longer period in a container composed of a plastic packing material having a small oxygen-permeation coefficient will cause a problem of the poor recoloration, mentioned above. On the other hand, storing a bleach-fixer for a longer period in a container composed of a plastic packing material having a large oxygen-permeation coefficient will cause oxygen-decomposition of sulfite and thiosulfate, deteriorating the performance of bleach-fixer; the phenomenon where both types of storing conflict with each other.

In view of such drawbacks, having devotedly studied the solutions, the inventors have reached the following findings, which in turn have realized the present invention:

By regulating the proportion of contained aminopolycarboxylic acid which is a free chelating agent usually contained in a bleach-fixer and serving as a stabilizing agent for ferric aminopolycarboxylate, a bleach-fixer can be stably stored without incurring the problems such as the failure in recoloration, mentioned above, even if the bleach-fixer is stored for an extended period in a container composed of a plastic packing material having a small oxygen-permeation coefficient, and; by selecting a content of contained sulfite in proportion of content of contained aminopolycarboxylic acid, mentioned above, the decomposition of the sulfite can be considerably inhibited.

SUMMARY OF THE INVENTION

The present invention has been intended to cope with the above-mentioned drawbacks.

Therefore, it is the object of the present invention to provide the method of storing color photographic developer, wherein a color developer, which does not require a procedure to blend necessary ingredients, and has only a weak toxity which in turn ensures safe handling, can be stored for a long period of time without incurring the deterioration of photographic properties.

It is another object of the invention to provide a method of storing bleach-fixer, wherein a bleach-fixer can be stored, like a color developer, for a long period without deteriorating its photographic properties, and as a result, the bleach-fixer is used for bleach-fixing process without incurring the problem of poor recoloration.

The above-mentioned objects of the present invention can effectively by attained by a method characterized in that storing a photographic processing solution selected from the group consisting of a liquid color developer containing ingredients given below and a liquid bleach-fixer containing ingredients given below in an container made of plastic material of which oxygen permeation coefficient is 0 to 50 ml/($m^2$. atm.day) under temperature at 20° C. and relative humidity at 60%;

[Developer]

(AA) an aromatic primary amine color developing agent;

(BB) an alkyl-substituted hydroxylamine compound represented by the general formula [I];

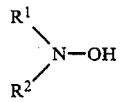

[I]

(wherein $R^1$ and $R^2$ are independently selected from the group consisting of a hydrogen atom and a substituted or unsubstituted alkyl group having 1 to 3 carbon atoms, provided that at least one of $R^1$ and $R^2$ is an unsubstituted alkyl group having 1 to 3 carbon atoms and that $R^1$ and $R^2$ may be combined with each other to form a ring) and (CC) an alkaline ingredient for making pH of said liquid color developer not less 9.5;

[Bleach-fixer]

(OO) a ferric aminopolycarboxylate, (PP) an aminopolycarboxylic acid at a quantity of 0 to $1\times10^{-3}$ mol per liter of said liquid bleach-fixer, (QQ) a thiosulfate and (RR) a sulfite at a quantity of $1\times10^{-3}$ to $2\times10^{-1}$ mol per liter of said liquid bleach-fixer.

The present invention is characterized in that, with a color developer, the ingredient (BB) contained as a preservative has the following features: being a specific alkyl-substituted hydroxylamine, it has a limited toxity which in turn allows safe handling, and performs excellently as a preservative; it has a limited reactivity with the ingredient (CC), or an alkali agent, and can stably coexist, in a container, with the similar agent, and; even if being decomposed, it does not generate a large amount of ammonia gas or nitrogen gas, and, therefore, the container is seldom broken. The present invention is further characterized in that the container storing the color developer comprises a plastic packing material having an oxygen-permeation coefficient smaller than a specific level, and, accordingly, the oxidation of the color developer stored in the container can be satisfactorily inhibited, and, as a result, the color developer having a limited toxity which in turn allows safe handling can be stored for an extended period of time without deteriorating its photographic properties.

Also, according to the present invention, a bleach-fixer comprising ferric aminopolycarboxylate as an oxidizing agent, thiosulfate as a reducing agent, less than a specific proportion of aminopolycarboxylic acid, and a specific amount of sulfite serving as a preservative to prevent oxygen-decomposition of thiosulfate can be stably stored for a long period without incurring the deterioration of its photographic properties of the bleach-fixer, by storing it in a container composed of a plastic packing material whose oxygen-permeation coefficient is less than a specific level.

The presumed reasons for such excellent effects are as follows.

(1) The aminopolycarboxylic acid contained in bleach-fixer is oxidized by another ingredient (OO), ferric aminopolycarboxylate, and, this generates ferrous aminopolycarboxylate, a reduction product of ferric aminopolycarboxylate. However, as the content of aminopolycarboxylic acid is less than a specific level, the generated ferrous aminopolycarboxylate is of a small amount.

(2) As a small amount of ferrous aminopolycarboxylate is generated within a bleach-fixer, the ferrous aminopolycarboxylate functions to considerably inhibit the oxygen-decomposition of the sulfite, and, accordngly, the sulfite stably provides its performance as a preservative, as a result, the thiosulfate as a reducing agent stably exists without being decomposed by oxygen.

(3) As a concentration of sulfite is less than a specific level, the sulfite scarcely reduces ferric aminopolycarboxylate, and, accordingly, the generation of ferrous aminopolycarboxylate is significantly inhibited.

Because the bleach-fixer, above, comprises components respectively not readily oxidized or reduced, and can be stably stored for a long period. Accordingly, even if the bleach-fixer after a long period of storing is used for bleach-fixing process, a dye in silver halide color photographic light-sensitive material does not make a leuco material, and, as a result, poor recoloration does not occur. Additionally, a container composed of a plastic packing material having a small oxygen-permeation coefficient can stably store sulfite, allowing satisfactory bleach-fixing process.

As can be understood from the description, above, according to the invention, it is possible for a user of a mini-laboratory system for private use to store color developer, as well as bleach-fixer, always at stable conditions, and he/she can rapidly and correctly develop silver halide color photographic light-sensitive material.

DETAILED DESCRIPTION OF THE INVENTION

The present invention is hereinafter described in detail.

[Container of Storing, according to the Invention]

According to the invention, a color developer comprising the previously mentioned ingredients (AA) and (CC),as well as a bleach-fixer comprising the previously mentioned ingredient (OO) AND (RR) are stored in containers respectively composed of a plastic packing materal having an oxygen-permeability coefficient of less than 50 ml/($m^2$.atm.day)(temperature, 20 °C.; relative humidity, 65%), and, more preferably, 0 to 25 ml/($m^2$.atm.day).

An oxygen-permeation coefficient can be measured by a method described in "$O_2$ Permeation of Plastic Container", Modern Packing"; N. J. Calyan, 1968), December issue, pp. 143–145.

Those available as a plastic packing material forming a container according to the invention are as follows: a sheet made of a plastic, having a small oxygen-permeation coefficient, such as polyvinylidene chloride, nylon, saponified ethylene-vinyl acetate copolymer, polyvinyl alcohol and others; a sheet comprising a sheet of any of the above-mentioned plastics and provided with a lamination of metal such as aluminum or the like, and, the similar sheet provided with a deposition of metal such as aluminum or the like; a multi-layered sheet formed by bonding any of the already mentioned sheets with a sheet made of polyethylene, ethylene-vinyl acetate copolymer or the like; and others. A container may be formed by singly or combinedly using any of these sheets.

Among these plastic packing materials, those especially preferably used are polyvinylidene chloride, nylon, saponified thtylene-vinyl acetate copolymer, because they have small oxygen-permeation coefficients, a formed container has a large strength, and they may be easily formed into containers.

There is no typical configuration for such a container, and the container may be whichever a bottle type, cubic type, bellows type or the like. For example, when forming a cubic type container, it may be formed with a laminated material obtained by jointly extruding any of the above-mentioned plastic packing materials.

Figure 1:
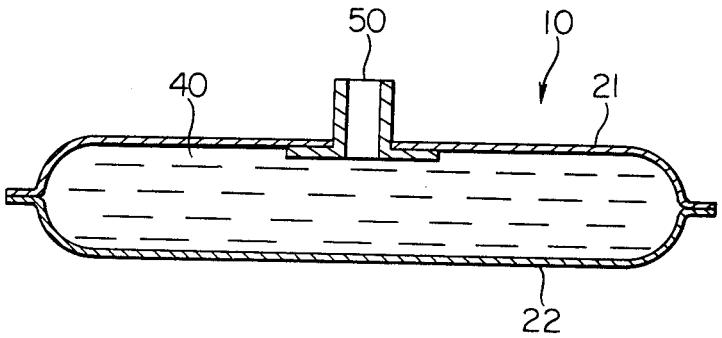
FIGS. 1 and 2 independently illustrate a typical constitution of a container used according to the present invention.
Figure 2:
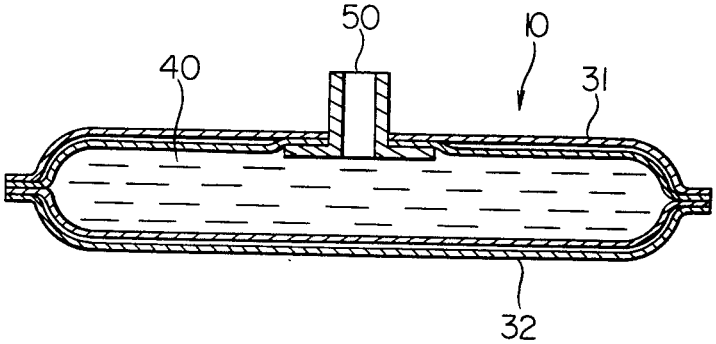

Being compact, and allowing easy handling, a flexible bellows type container is preferable. The examples of such a bellows type container are shown in FIGS. 1 and 2. With the example in FIG. 1, external walls 21 and 22 constituting one pair and independently made of a single square flexible sheet are bonded to each other with their circumferential rims tightly contacting to each other, so as to form a container 10. With the example in FIG. 2, external walls 31 and 32 constituting a pair and respectively made of two independent square flexible sheets are bonded air-tight to each other with their circumferential rims tightly contacting to each other, so as to form a container 10. The latter is an example, so to speak, having external walls of multi-layered sheet. Reference numeral 40 represents a container chamber for a color developer or bleach-fixer, and reference numeral 50 represents an inlet/outlet of such processing solutions.

As can be shown by the examples in FIG. 1, if a sheet forming the external wall of the container 10 is single-layered, an oxygen-permeation coefficient of the sheet should be, as mentioned previously, 0 to 50 ml($m^2$.atm.-day). In contrast, if each of the external walls of the container 10 comprises two sheets, as can be shown by the example in FIG. 2, an oxygen-permeation coefficient of the two sheets as one entity should be 0 to 50 ml/$m^2$.atm.day).

As a sheet forming such an external wall, a single-layered plastic sheet, a multi-layered plastic sheet formed by bonding a plurality of plastic sheets together, and others are available. Additionally, such a plastic may be solely composed of plastic sheets, or may be a plastic sheet having a lamination of metal foil, paper or the like, or may be a plastic sheet having an evaporation-deposited metal film.

The available examples of a single-layered plastic sheet are as follows: plastic sheets composed of polyvinylidene chloride, nylon, saponified ethylene-vinyl acetate copolymer, polyvinyl alcohol, and the like; sheets comprising any of the above-mentioned plastic sheets, and having a lamination of metal foil, such as of aluminum, or a lamination of paper or the like; sheets comprising any of the above-mentioned plastic sheets, and having an evaporation-deposited metal film of, for example, aluminum.

The available examples of a multi-layered plastic sheet comprising a plurality of plastic sheet bonded together are as follows: a three-layered sheet comprising polyethylene terephthalate/polyvinyl alcohol-ethylene copolymer/polyethylene; a three-layered sheet comprising drawn polypropylene/polyvinyl alcohol-etylene copolymer/polyethylene; a three-layered sheet comprising undrawn polypropylene/polyvinyl alcohol-ethylene copolymer/polyethylene; a three-layered sheet comprising nylon/aluminum foil/polyet-ylene; a three-layered sheet comprising polyethylene terephthalate/aluminum foil/polyethylene; a four-layered sheet comprising cellophane/polyethylene/aluminum foil/polyethylene; a three-layered sheet comprising aluminum foil/paper/polyethylene; a four-layered sheet comprising polyethylene terephthalate/polyethylene/aluminum foil/polyethylene; a four-layered sheet comprising nylon/polyethylene/aluminum foil/-polyethylene; a four-layered sheet comprising paper/-polyethylene/aluminum foil/polyethylene; a four-layered sheet comprising polyethylene terephthalate/aluminum foil/polyethylene terephthalate/-polypropylene; a four-layered sheet comprising polyethylene terephthalate/aluminum foil/polyethylene terephthalate/high-density polyethylene; a four-layered sheet comprising polyethylene terephthalate/aluminum foil/polyethylene/low-density polyethylene; a two-layered sheet comprising polyvinyl alcohol-ethylene copolymer/polypropylene; a three-layered sheet comprising polyethylene terephthalate/aluminum foil/polypropylene; a three-layered sheet comprising paper-/aluminum foil/polyethylene: and, especially preferably: a four-layered sheet comprising polyethylene/-polyvinylidene chloride-coated nylon/polyethylene/-condensation product of ethylvinyl acetate and polyethylene; a three-layered sheet comprising polyethylene/-polyvinylidene chloride coated nylon/polyethylene; a five-layered sheet comprising condensation product of ethylvinyl acetate and polyethylene/polyethylene/nylon having an evaporation-deposited aluminum film-/polyethylene/condensation product of ethylvinyl acetate and polyethylene; a four-layered sheet comprising nylon having an evaporation-deposited aluminum film-/polyethylene/condensation product of ethylvinyl acetate and polyethylene; a three-layered sheet comprising drawn polypropylene/polyvinylidene chloride-coated nylon/polyethylene; a three-layered sheet comprising polyethylene/polyvinylidene chloride-coated nylon/-polyethylene; a three-layered sheet comprising drawn polypropylene/polyvinyl alcohol-ethylene copolymer/low density polyethylene; a three-layered sheet comprising drawn polypropylene/polyvinyl alcohol-ethylene copolymer/undrawn polypropylene; a three-layered sheet comprising polyethylene terephthalate/-polyvinyl alcohol-ethylene copolymer/low density polyethylene; a three-layered sheet comprising drawn nylon/polyvinyl alcohol-ethylene copolymer; low density polyethylene; a three-layered sheet comprising undrawn nylon/polyvinyl alcohol-ethylene copolymer/low density polyethylene; and others.

When forming a container with multi-layered plastic sheets each comprising a plastic sheet having an oxygen-permeation coefficient of less than 50 ml/$m^2$.atm.-day), bonded thereon, a plastic sheet composed of, for example, polyethylene, ethylene-vinyl acetate copolymer, or the like, each of which being more flexible, though having a larger oxygen-permeation coefficient, a satisfactory impermeability to oxygen can be resulted, and a container not liable to cause pinholes and has an excellent durability can be obtained.

The thickness of a sheet forming the external wall of container substantially varies according to the constitutional material, and there is no specific value. However, the preferred thickness is generally within a range of 5 to 1500 $\mu$m, and, more favorably, 10 to 500 $\mu$m.

[Color developer according to the invention]

According to the invention, a color developer stored in a container contains, as mentioned previously, the ingredients (AA) and (CC).

A usable aromatic primary amine as the ingredient (AA) is, for example, an N,N'-dialkyl-p-phenylenediamine compound, alkyl and phenyl groups may be substitued by an optional arbitrary substituent. More specifically, a useful aromatic primary amine is typified by any of an N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamideethyl-3-methyl-4-aminoaniline sulfate, N-ethyl-N-$\beta$-hydroxyethylaniline, 4-amino-3-methyl-N,N'-diethylaniline, 4-amino-3-N-(2-methoxyethyl)-N-ethyl-3-methylaniline- p-toluenesulfonate, N-ethyl-N-propylparaphenylenediamine sulfate, 4-amino-3-methyl-N-ethyl-N-β-hydroxyethylaniline sulfate, 4-amino-3-methyl-N,N'-diethylaniline sulfate, 4-amino-N-(β-methoxyethyl)-N-ethyl-3-methylaniline-p-toluenesulfonate, N,N'-diethyl-3-(β-methanesulfonamideethyl)-4-aminoaniline sulfate, and the like.

A preferred content of such an aromatic primary amine contained is usually within the range of 0.005 to 0.2 mol per l color developer.

Aromatic primary amines especially useful as a color developer are those of paraphenylenediamines independently having at least one water-soluble group (hydrophilic group) within their amino group. The typical examples of such a water-soluble group are as follows.

o Water-soluble groups $-(CH_2)_n-CH_2OH$ $-(CH_2)_m-NHSO_2-(CH_2)_n-CH_3$ $-(CH_2)_m-O-(CH_2))_n-CH_3$ $-(CH_2CH_2O)_nC_mH_{2m+1}$ $-COOH$ $-SO_3H$ (m and n independently represent an integer more than 0.)

The typical examples of aromatic primary amine of such paraphenylenediamines respectively having at least one water-soluble group are those represented by the following formulas.

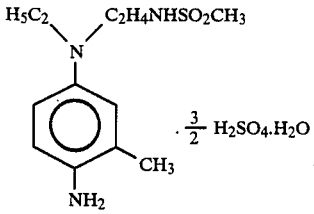

(1)

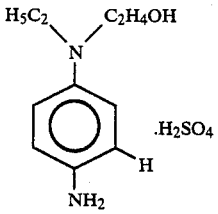

(2)

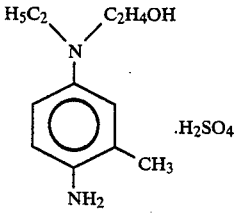

(3)

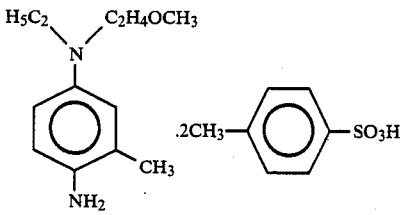

(4)

-continued

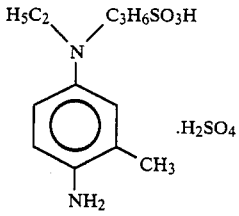

(5)

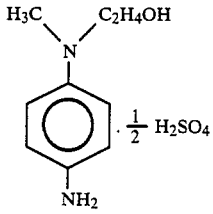

(6)

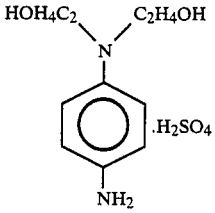

(7)

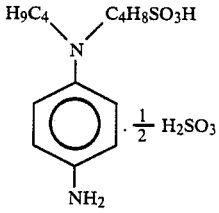

(8)

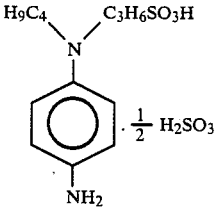

(9)

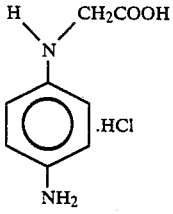

(10)

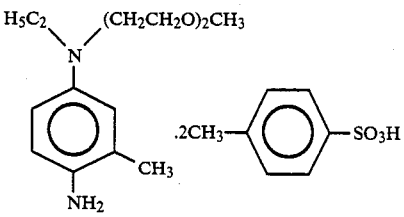

(11)

-continued

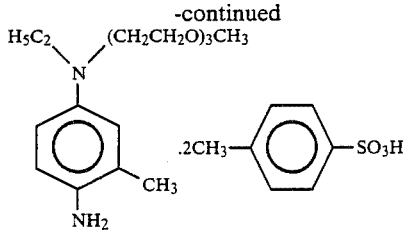

(12)

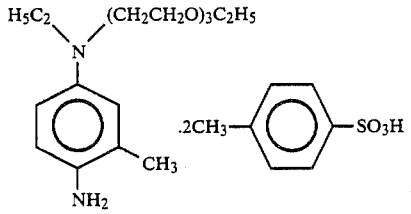

(13)

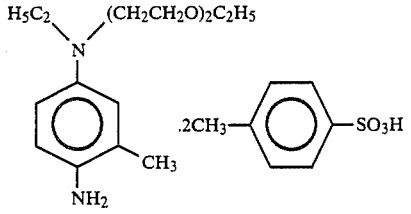

(14)

Especially useful aromatic amine primary amines are the compounds having in their amino group a substituent such as $-(CH_2)_n-CH_2OH$, $-(CH_2)_m-NH-SO_2-(CH_2)_n-CH_3$, $-(CH_2)_mO-(CH_2)_n-CH_3$, $-(CH_2CH_2O)_nC_mH_{2m+1}$, and, more specifically, such compounds are typified by those represented by the above-mentioned formulas (1), (2), (3), (4) (5), (6) and (7). In thse groups, above, m and n are independently an integer more than 0, or , preferably an integer 0 through 5.

Those most favorable among these compounds are ones represented by the above-mentioned formulas (1), (3) and (4), and the compounds represented by the formulas (1) and (3) are especially advantageously used.

As the examples of the hydroxyl amine compounds represented by the general formula, those disclosed in U.S. Pat. Nos. 3,287,125, 3,293,034 and 3,287,124 can be mentioned.

The compounds which are advantageously used in the present invention are given below:

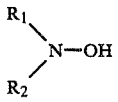

| Compound No. | $R_1$ | $R_2$ |
|---|---|---|
| A-1 | $-C_2H_5$ | $-C_2H_5$ |
| A-2 | $-CH_3$ | $-CH_3$ |
| A-3 | $-C_3H_7$(n) | $-C_3H_7$(n) |
| A-4 | $-C_3H_7$(i) | $-C_3H_7$(i) |
| A-5 | $-CH_3$ | $-C_2H_5$ |
| A-6 | $-C_2H_5$ | $-C_3H_7$(i) |
| A-7 | $-CH_3$ | $-C_3H_7$(i) |
| A-8 | $-H$ | $-C_2H_5$ |
| A-9 | $-H$ | $-C_3H_7$(n) |
| A-10 | $-H$ | $-CH_3$ |
| A-11 | $-H$ | $-C_3H_7$(i) |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |

-continued

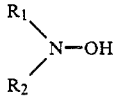

| Compound No. | $R_1$ | $R_2$ |
|---|---|---|
| A-15 | $-C_2H_4COOH$ | $-C_2H_4COOH$ |
| A-16 | 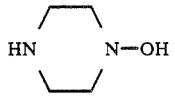 | |
| A-17 | 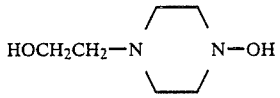 | |
| A-18 | 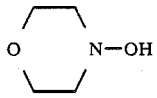 | |
| A-19 | 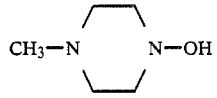 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |

Among these compounds, A-1, A-2, A-8, A-9, A-12, A-18 and A-21 are perticularly useful in the present invention.

These compounds of the present invention are usually used in the form of, for example, a free amine a chloride, a sulfate, a p-toluen sulfonate, an oxalate, a phosphate and an acetate.

The compound represented by the general formula [I] is incorporated in the liquid color developer of the present invention usually at a quantity of 0.2 to 50 g per liter of the liquid color developer, preferably 0.5 to 30 g/l, and, most preferably, 1 to 15 g/l.

The alkali agent, or the ingredient (CC), is an ingredient to make the pH of color developer more than 9.5, and is available in the form of, for example, sodium hydroxide, potassium hydroxide, sodium carbonate, potassium carbonate, sodium tertiary phosphate, potassium tertialy phosphate or the like. Some of these alkali agents serves as pH-adjusting agents, or as buffer agents.

In addition to the above-mentioned ingredients (AA) and (CC), various additives are, if so required, blended into a color developer in accordance with the present invention. Such useful additives are a preservative composed of sulfite, anti-fogging agent, development inhibiting agent, development accelerating agent, organic solvent, chelating agent functioning as a water softener or a heavy metal-coordinating agent, auxiliary developer and the like.

As a preservative comprising sulfite, sodium sulfite, potassium sulfite, lithium sulfite, ammonium sulfite, sodium bisulfite, potassium metabisulfite, sodium formardehyde bisulfite and the like are available. The preferred content of such a sulfite is usually 0.4 to 2.5 mol, or more specifically, 0.5 to 2.5 mol per one l color developer.

The examples of useful anti-fogging agents are as follows: mercapto compounds such as 1-phenyl-5-mercaptotetrazole, sodium 2-mercaptobenzimidazole-5-sulfonate, and others; indazole compounds such as 5-nitroindazole, and others; benztriazole compounds such as 5-methylbenztriazole, and others; inorganic halide compounds such as potassium bromide, potassium iodide, and others; 6-nitrobenzimidazoles disclosed in the specification of U.S. Pat. No. 2,496,940; 5-nitrobenzimidazoles disclosed in the specifications of U.S. Pat. Nos. 2,497,917 and No. 2,656,271; o-phenylenediamine mercaptobenzoxadiazole and thiouracil; heterocyclic compounds described in Japanese Patent Examined Publication No. 41675/1971; and others. The preferred content of such an anti-fogging agent is usually 0.001 to 30 g, or more specifically, 0.001 to 5 g per one l color developer.

As a useful development inhibiting agent, sodium bromide, potassium bromide, potassium iodide and the like are available, the preferred content of such a development inhibiting agent is usually 0.001 to 30 g, or more specifically, 0.05 to 5 g per one l color developer.

The examples of a useful development accelerating agent are as follows: pyridium compounds, other cationic compounds, cation dyes such as phenosafranine, neutral salts such as thalium nitrate described in the specifications of U.S. Pat. Nos. 2,648,604 and 3,671,247, as well as in Japanese Patent Examined Publication No. 9503/1979; polyethyleneglycol or derivatives thereof, and nonion compounds, described in the specifications of U.S. Pat, Nos. 2,533,990, 2,531,832, 2,950,970 and 2,577,127, as well as in Japanese Patent Examined Publication No. 9504/1979; organic solvents, and organic amine, ethanol amine, ethylenediamine, diethanolamine, triethanolamine and the like, described in Japanese Patent Examined Publication No. 9509/1979; and others. Also, other useful development accelerating agents include benzyl alcohol and phenethyl alcohol described in the specification of U.S. Pat. No. 2,304,925, and, in addition, acetylene glycol, methylethylketone, cyclohexane, thioethers, pyridine, ammonia, hydrazine, amines, and others. The preferred content of such a development accelerating agent is usually 0.05 to 150 g, or more specifically, 0.5 to 30 g per one l color developer.

The examples of a useful organic solvent include ethylene glycol, diethylene glycol, triethylene glycol, dimethylformamide, Methyl cellosolve, hexylene glycol, ethanol, methanol, acetone, dimethylformardehyde, and the other compounds described in Japanese Patent Examined Publications No. 33378/1972 and No. 9509/1979. The preferred content of such an organic solvent is usually 0.05 to 100 g, or more specifically, 0.5 to 30 g per one l color developer.

The examples of a useful chelating agent which serves as a water-softener or heavy metal-coordinating agent are as follows: phosphates such as polyphosphate; aminopolycarboxylic acid such as nitrilotriacetic acid, 1,3-diaminopropanoltetraacetic acid, diethylenetriaminepentaacetic acid, hydroxyethyliminodiacetic acid, and the like; oxycarboxylic acids such as citric acid, gluconic acid, and the like; organic acids such as 1-hydrocyethylidene-1,1-diphosphonic acid, and the like; aminopolyphosphonic acids such as aminotri(methylenephosphonic acid) and the like; polyhydroxy compounds such as 1,2-dihydroxybenzene and the like; and others. The preferred content of such a chelating agent is usually 0.05 to 160 g, or more specifically, 0.1 to 50 g per one l color developer.

The examples of useful auxiliary developer include N-methyl-p-aminophenol sulfate (Methol), phenidone, N,N-diethy-p-aminophenol hydrochloride, N,N,N,N-tetramethyl-p-phenylenediamine hydrochloride, and the like. The preferred content of such an auxiliary developer is usually 0.01 to 30 g per one l color developer. Additionally, in accordance with a requirement, the following compounds may be also used: competitive couplers such as citrazinic acid and the like; fogging agents including tin chelating agent such as tin N,N,N-trimethlenephosphonate, tin citrate, and the like, as well as borohydride compounds such as tert-butylaminoborane and the like; colored couplers; development inhibiting-releasing couplers (so-called DIR couplers); compounds to release development inhibiters; and others.

The useful defoaming agents include silicon defoaming agents and others. The preferred content of such a defoaming agent is usually $5\times10^{-4}$ to 5 g per one l color developer.

An aromatic primary amine, used as the ingredient (AA), should be used at the pH of more than 9.5, and more favorably, at the range of pH9.6 to 13, and most favorably, at the range of pH 9.8 to 12.5. The preferred temperature range for color developing is 25° to 75° C., and more specifically, 30° to 62° C.

TYPICAL EXAMPLES OF COLOR DEVELOPER ACCORDING TO THE INVENTION

The typical examples according to the present invention are hereinafter described, however, the scope of the invention is not limited only to these examples.

PREPARATION OF COLOR DEVELOPERS

Color developer 1 (Comparison)

| | |
|---|---|
| Benzyl alcohol | 8 g |
| Ethylene glycol | 10 g |
| Polyvinyl pyrrolidone | 1.0 g |
| Potassium sulfite | 5.0 g |
| N—ethyl-N—ethyl-β-methansulfonamideethyl-3-methyl-4-aminoaniline sulfate | 5.0 g |
| N—ethyl-N—β-hydroxyethylaniline sulfate | 5.0 g |
| Potassium carbonate | 30 g |
| Potassium bromide | 1.2 g |
| 1-hydroxylethylidene-1,1-diphosphonic acid | 0.3 g |
| Potassium hydride: an amount to set the pH of solution at 10.35. | |
| Water: an amount to make one l solution | |

(Water contained 0.5 ppm iron ion, and 0.05 ppm copper ion.)

The above-mentioned materials were blended and dissolved, whereby hydroxylamine sulfate as a preservative was added at the rate of 3 g/l, then the solution was treated so as to have the pH value of 10.35, thus a color developer for comparison was prepared. This was designated "color developer 1".

Color developer 2 (Invention)

A color developer was prepared in a manner identical to that of the preparation for color developer 1, except that monomethylhydroxylamine was used, at the rate of 3 g/l, instead of hydroxylamine sulfate. This was designated "color developer 2".

Color developer 3 (Invention)

A color developer was prepared in a manner identical to that of the preparation for color developer 1, except that dimethylhydroxylamine was used, at the rate of 3 g/l, instead of hydroxylamine sulfate. This was designated "color developer 3".

Color developer 4 (Invention)

A color developer was prepared in a manner identical to that of the preparation for color developer 1, except that monoethylhydroxylamine was used, at the rate of 3 g/l, instead of hydroxylamine sulfate. This was designated "color developer 4".

Color developer 5 (Invention)

A color developer was prepared in a manner identical to that of the preparation for color developer 1, except that diethylhydroxylamine was used, at the rate of 3 g/l, instead of hydroxylamine sulfate. This was designated "color developer 5".

Color developer 6 (Invention)

A color developer was prepared in a manner identical to that of the preparation for color developer 1, except that monopropylhydroxylamine was used, at the rate of 3 g/l, instead of hydroxylamine sulfate. This was designated "color developer 6".

Color developer 7 (Invention)

A color developer was prepared in a manner identical to that of the preparation for color developer 1, except that dipropylhydroxylamine was used, at the rate of 3 g/l, instead of hydroxylamine sulfate. This was designated "color developer 7".

FABRICATION OF CONTAINER

Container 1 (Comparison)

Two square-shaped single-layered sheets D constituting a pair and each composed of polyethylene (200 μm) were prepared, and their circumferential rims were bonded together, and an inlet/outlet of processing solution was provided on one square sheet, thus a bellows-type container (capacity; 5 l) was formed. This was designated "container 1". The oxygen-permeation coefficient of the container 1 is 480 ml/($m^2$·atm·day) (temperature, 20° C.; relative humidity, 65%).

Container 2 (Comparison)

Two square-shaped single-layered sheets E constituting a pair and each composed of polyethylene-vinyl acetate copolymer (250 μm) were prepared, and their circumferential rims were bonded together, and an inlet/outlet of processing solution was provided on one square sheet, thus a bellows-type container (capacity; 5 l) was formed. This was designated "container 2". The oxygen-permeation coefficient of the container 2 is 100 ml/($m^2$·atm·day) (temperature, 20° C.; relative humidity, 65%).

Container 3 (Comparison)

A pair of square-shaped multi-layered sheets each comprising an independent single-layered sheet F composed of polyethylene (50 μm), an independent single-layered square sheet G composed of polyethylene-vinyl acetate copolymer (100 μm) and an independent single-layered square sheet H composed of polyethylene-vinyl acetate copolymer (100 μm) were prepared, then the circumferential rims of the two multi-layered sheets members were bonded together, and at the same time, an inlet/outlet was provided on the one of square-shaped multi-layered sheets, thus a bellows-type container (capacity; 5 l) was formed. This was designated "container 3". The oxygen-permeation coefficient of the container 3 is 200 ml/($m^2$·atm·day) (temperature, 20° C.; relative humidity, 65%).

Container 4 (Invention)

A pair of square-shaped multi-layered sheets each comprising an independent three-layered square sheet A composed of polyethylene-vinyl acetate copolymer (20 μm)/nylon (15 μm)/polyethylene (15 μm) and an independent single-layered square sheet B composed of polyethylene-vinyl acetate copolymer (100 μm) were prepared, then the circumferential rims of the pair of multi-layered sheets were bonded together, and at the same time, an inlet/outlet was provided on the one of square-shaped multi-layered sheets, thus a bellows-type container (capacity; 5 l) was formed. This was designated "container 4". The oxygen-permeation coefficient of the container 4 is 6 ml/($m^2$·atm·day) (temperature, 20° C.; relative humidity, 65%).

Container 5 (Invention)

A pair of two-layered square-shaped sheets C each comprising a nylon (75 μm)/polyethylene (75 μm) were prepared, then the circumferential rims of the pair of square-shaped sheets were bonded together, and at the same time, an inlet/outlet was provided on the one of square-shaped multi-layered sheets, thus a bellows-type container (capacity; 5 l) was formed. This was designated "container 5". The oxygen-permeation coefficient of the container 5 is 20 ml/($m^2$·atm·day) (temperature, 20° C.; relative humidity, 65%).

<Test (1) for preservation-stability of color developers>

Seven examples of each of the above-mentioned containers 1 through 5 were fabricated, thus providing the five groups of containers. The previously mentioned color developers 1 through 7 was respectively filled into each of the seven containers per group at the rate of 4.9 l, then each inlet/outlet was sealed air-tight. Every container filled with color container was stored for two months, in a test chamber whose internal environments were set at 38° C. of temperature, 65% of relative humidity, and one atm of atomospheric pressure.

After the storage, the conditions of containers were examined. In the case where the containers 4 and 5 according to the invention were used to store any of the color developers 2 through 7 according to the invention, the gas pressure in a container after color developer having been allowed to stand had not increased considerably, the breakage was not found on these containers, and each color developer was remarkably satisfactorily preserved.

In contrast, in the case where the comparison color developer 1 was stored in the containers, the gas pressure in each container was high due to generated nitrogen gas, and there was a strong possibility to damage a container.

Next, using each of color developers after storage, the test to form a photograph was carried out, in compliance with the following conditions, by actually treating a silver halide photographic light-sensitive material, for color paper (manufactured by Konishiroku Photo Industry Co., Ltd.), which had been already exposed with a step-type exposure wedge for sensitometry, whereby the minimum density (fogging) and the maximum density were examined with an obtained photograph. The results are shown in Table 1, given later.

In relation to the densities, using an optical densitometer "PDA-60" (manufactured by Konishiroku Photo Industry Co., Ltd.), with a blue-filter, the density of yellow-dye (maximum density) was measured, and at the same time, the minimum density was measured with the similar method.

[Conditions to form photograph]

Silver halide photoqraphic liqht-sensitive material for color photograph

"SAKURA COLOR SR paper" (manufactured by Konishiroku Photo Industry Co., Ltd.)

| Standard treatment processes: | |
|---|---|
| (1) Color developing (38° C., 3 min 30 sec) | |
| (2) Bleach-fixing (38° C., 1 min 30 sec) | |
| (3) Stablizing (25~35° C., 3 min) | |
| (4) Drying (75~100° C., approx. 2 min) | |
| Bleach-fixer: | |
| Ferric ammonium ethylenediaminetetraacetate dihydride | 60.0 g |
| Ethylenediaminetetraacetic acid | 3.0 g |
| Ammonium thiosulfate (70% aqueous solution) | 100 ml |
| Ammonium sulfite (40% aqueous solution) | 27.5 ml |
| Water: an amount to complete one l solution | |

The materials, above, were mixed and dissolved to make a solution, which was treated with potassium carbonate or glacial acetic acid to have the pH value of 7.1.

| Stabilizer | |
|---|---|
| Ethylene glycol | 1.0 g |
| 1-hydroxylethylidene-1,1-diphosphonic acid (60% aqueous solution) | 1.0 g |
| Aqueous ammonia (25% ammonium hydroxide aqueous solution) | 2.0 g |
| Water: an amount to complete one l solution | |

The materials, above, were mixed and dissolved to make a solution, which was treated with sulfuric acid to have the pH value of 7.1.

<Test (2) for preservation-stability of color developers>

Color developers were stored in a manner identical to that in the test (1) for preservation-stability of color developers, except that a temperature in the test chamber was changed to 58° C.

After the storage, the conditions of containers were examined. In the case where the containers 4 and 5 according to the invention were used to store any of the color developers 2 through 7 according to the invention, the gas pressure in a container after color developer having been allowed to stand had not increased considerably, breakage was not found on these containers, and each color developer was remarkably satisfactorily preserved.

In contrast, in the case where the comparison color developer 1 was stored in the containers, the gas pressure in each container was high due to generated ammonia gas and nitrogen gas, and there was a strong possibility to damage a container.

Next, using each of color developers after storage, the test to form a photograph was carried out in a manner identical to test 1, whereby the results identical to those in table 1 were obtained.

<Test (3) for preservation-stability of color developers>

Color developers were stored in a manner identical to that in the test (1) for preservation-stability of color developers, except that a temperature in the test chamber was changed to 78° C.

After the storage, the conditions of containers were examined. In the case where the containers 4 and 5 according to the invention were used to store any of the color developers 2 through 7 according to the invention, the gas pressure in a container after color developer having been allowed to stand had not increased considerably, the breakage was not found on these containers, and each color developer was remarkably satisfactorily preserved.

In contrast, in the case where the comparison color developer 1 was stored in the containers, the gas pressure in each container was high due to generated ammonia gas and nitrogen gas, and there was a strong possibility to damage a container.

Next, using each of color developers after storage, the test to form a photograph was carried out in a manner identical to test 1, whereby the results identical to those in table 1 were obtained.

TABLE 1

| | Color developer 1 (Comparison) | Color developer 2 (Invention) | Color developer 3 (Invention) | Color developer 4 (Invention) | Color developer 5 (Invention) | Color developer 6 (Invention) | Color developer 7 (Invention) |
|---|---|---|---|---|---|---|---|
| Minimum density (fogging) | | | | | | | |
| Container 1 (Comparison) | 0.14 | 0.13 | 0.10 | 0.09 | 0.08 | 0.09 | 0.10 |
| Container 2 (Comparison) | 0.19 | 0.12 | 0.11 | 0.09 | 0.07 | 0.08 | 0.11 |
| Container 3 (Comparison) | 0.16 | 0.12 | 0.07 | 0.09 | 0.06 | 0.09 | 0.09 |
| Container 4 (Invention) | 0.29 | 0.06 | 0.06 | 0.09 | 0.06 | 0.06 | 0.08 |
| Container 5 (Invention) | 0.22 | 0.06 | 0.06 | 0.07 | 0.04 | 0.07 | 0.07 |
| Maximum density | | | | | | | |
| Container 1 (Comparison) | 2.21 | 2.12 | 2.08 | 2.16 | 2.11 | 2.12 | 2.16 |
| Container 2 (Comparison) | 2.19 | 2.17 | 2.12 | 2.14 | 2.06 | 2.08 | 2.09 |
| Container 3 (Comparison) | 2.41 | 2.36 | 2.26 | 2.23 | 2.14 | 2.21 | 2.18 |

TABLE 1-continued

| | Color developer 1 (Comparison) | Color developer 2 (Invention) | Color developer 3 (Invention) | Color developer 4 (Invention) | Color developer 5 (Invention) | Color developer 6 (Invention) | Color developer 7 (Invention) |
|---|---|---|---|---|---|---|---|
| Container 4 (Invention) | 2.71 | 2.75 | 2.74 | 2.75 | 2.75 | 2.72 | 2.75 |
| Container 5 (Invention) | 2.72 | 2.76 | 2.76 | 2.74 | 2.72 | 2.73 | 2.74 |

As can be understood from the results in table 1, the use of the method according to the invention can stably store a color developer for a long period, without jeopardizing its photographic performance nor without damaging a container. As a result, color developing process is satisfactorily carried out even with a stored color developer.

In contrast, in the case where a color developer is stored in any of the comparison containers 1 through 3, the performance of color developer is jeopardized by oxidation, and accordingly, a satisfactory developing process is impossible, because these containers respectively have a high oxygen-permeation coefficient.

Furthermore, when storing the comparison color developer 1, the decomposed color developer 1 generates ammonia gas and nitrogen gas, and accordingly, jeopardizes its own performance, thus making a satisfactory developing process impossible. Also, there is a strong possibility that a container is damaged in the course of storing the color developer due to the generated nitrogen gas.

[Bleach-fixer according to the invention]

According to the invention, a bleach-fixer stored in a container contains, as mentioned previously, the ingredients (OO) through (RR), and may further contain various additives, in accordance with a requirement.

The ingredient (OO), or ferric aminopolycarboxylate, functions as a bleacher. Though, an aminopolycarboxylic acid making such a ferric aminoppolycarboxylate can be any type of the similar acid, the following examples can be preferably used, However, the scope of the invention is not limited only to these compounds.

| | |
|---|---|
| (1) Diethylenetriaminepentaacetic acid | (Mw = 393.27) |
| (2) Trans-cyclohexanediaminetetraacetic acid | (Mw = 364.35) |
| (3) Triethylenetetraaminehexaacetic acid | (Mw = 494.45) |
| (4) Glycoletherdiaminetetraacetic acid | (Mw = 380.35) |
| (5) Hydroxylethylethylenediaminetetra-acetic acid | (Mw = 278.26) |
| (6) Ethylenediaminediacetic acid | (Mw = 176.17) |
| (7) 1,2-diaminopropanetetraacetic acid | (Mw = 306.27) |
| (8) Dihydroxyethylglycine | (Mw = 163.17) |
| (9) Nitrotriacetic acid | (Mw = 191.14) |
| (10) Nitrilotripropionic acid | (Mw = 233.22) |
| (11) Ethylenediaminedipropionic acid | (Mw = 277.15) |
| (12) Ethylenediamine-orthohydroxyphenyl-acetic acid | (Mw = 360.37) |
| (13) Tetrapotassium 1,2-bis(o-aminophenoxy) ethanetetraacerate | (Mw = 628.80) |
| (14) 1,3-diaminopropane-2-oltetraacetic acid | (Mw = 322.27) |
| (15) Iminodiacetic acid | (Mw = 133.10) |
| (16) Ethylenediaminediorthohydroxyphenyl-acetic acid | (Mw = 360.37) |
| (17) Hydroxyethyliminodiacetic acid | (Mw = 177.16) |
| (18) Ethylenediaminetetraacetic acid | (Mw = 292.25) |
| (19) Methyliminodiacetic acid | (Mw = 147.13) |
| (20) 1,3 diamino propane-tetraacetic acid | (Mw = 306.30) |

Among these aminopolycarboxylic acids, the especially advantageous are diethylenetriaminepentaacetic acid, cyclohexanediaminetetraacetic acid, hydroxyethyliminodiacetic acid, triethylenetetraminehexaacetic acid, 1,3-diamino propanetetraacetic acid, ethylenediaminetetraacetic acid, 1,2-diaminopropanetetraacetic acid, methyliminodiacetic acid, glycoletherdiaminetetraacetic acid and nitrilotripropionic acid.

The ingredient (OO), ferric aminopolycarboxylate, is used in the following forms: free acids (hydrogen salts); alkali metal salts including sodium salts, potassium salts, lithium salts and the like; ammonium salts; water-soluble amine salts including triethanolamine salts and the like; and others. More specifically, the ingredient is used in the form of a potassium salt, sodium salt, ammonium salt or the like. Such aminopolycarboxylic acids may be singly used, or two or more of them may be combinedly used. Also, polycarboxylic acids, such as tartaric acid, succinic acid, citric acid and the like may be jointly used.

There is no specific content for ferric aminopolycarboxylate contained in bleach-fixer, and it is proportionally determined on case-by-case basis depending upon the silver content in a silver halide photographic light-sensitive material being processed as well as the composition and the like of silver halide. Usually having a larger oxidation potential, a ferric aminopolycarboxylate may be used in a lower concentration when compared to other aminopolycarboxylates. Its preferred content is usually 5 to 500 g, or more specifically, 10 to 300 g per one l bleach-fixer.

An aminopolycarboxylic acid, or the ingredient (PP), may be an aminopolycarboxylic acid whose structure is either identical to or different from that of the similar polycarboxylic acid forming a ferric aminopolycarboxylate of the ingredient (OO).

According to the invention, the content of such an aminopolycarboxylic acid should be less than $1\times10^{-1}$ mol, or preferably, 0 to $5\times10^{-2}$ mol, and more specifically, 0to $2\times10^{-2}$ mol per one 1 bleach-fixer. If the content is excessively large, an increased proportion of the ferrous aminopolycarboxylate which is a product of the ingredient (OO), or a ferric aminopolycarboxylate, reduced by such an aminopolycarboxylic acid causes poor recoloration in the cause of bleach-fixing process, thus making satisfactory bleach-fixing impossible.

More than two types of aminopolycarboxylic acids may be mixedly used if the mixing ratio is within an allowable range in accordance with the invention.

The ingredient (QQ), a thiosulfate functions as a fixer for silver halide, and reacts with silver halide to form a water soluble complex salt. For such a thisulfate, those known compounds used as a fixer for silver halide can be used, and the scope of such compounds is not necessarily limited. However, more specifically, those usable include potassium thiosulfate, sodium thiosulfate, ammonium thiosulfate, and thiosulfates described in Japanese Patent Publication Open to Public Inspection No. 185435/1982.

Such a thiosulfate is used at the rate it can be dissolved into bleach-fixer solution. More specifically, the advantageous thiosulfate content is usually more than 5 g, or more favorably, more than 50 g, and most favorably, more than 70 g per one l bleach-fixer. Though the maximum allowable content depends on the solubility limit, a higher concentration is preferable.

The ingredient (RR), a sulfite, functions as a preservative inhibiting oxidation-decomposition of the thiosulfate. For such a sulfite, those known compounds usually used in a bleach-fixer or fixer can be used, and the scope of such compounds is not necessarily limited. However, more specifically, those usable include potassium sulfite, sodium sulfite, ammonium sulfite, acid sodium bisulfite, acid potassium bisulfite, acid ammonium bisulfite, potassium metabisulfite, sodium metabisulfite, ammonium metabisulfite, formaldesulfurous acid adduct and others. In addition, any compounds may be used only if they can emit sulfurous ions, and more than two of such compounds may be combinedly used.

According to the invention, the content of such a sulfite should be $1\times10^{-3}$ to $2\times10^{-1}$ mol, or preferably, $1\times10^{-2}$ to $1.5\times10^{-1}$ mol per one l bleach-fixer. If the content is excessively high, an increased proportion of the ferric aminopolycarboxylate tends to be readily reduced, resulting in increased amount of ferrous aminopolycarboxylate, which in turn causes poor recoloration. In contrast, if the content is escessively low, the thiosulfuric ions tend to be readily decomposed by oxidation. One advantage of the present invention is that, because a container is composed of a plastic packing material having a smaller oxygen-permeation coefficient, the thiosulfate less readily decomposes even if the content of sulfite is unconventionally low.

The preferred pH value of bleach-fixer is usually 2 to 9.8, or more specifically, 4 to 9, and most favorably, 5.0 to 8.5. The preferred temperature for storing bleach-fixer is usually 5° to 60° C., and more specifically, 20° to 45° C.

In addition to the above-mentioned ingredients (OO) and (RR), various additives may be incorporated into a bleach-fixer of the invention, in accordance with requirements.

One type of such a useful additive is an alkali halide or ammonium halide functioning as a bleach-accelerating agent. More specifically, the examples of such an additive include potassium bromide, sodium bromide, sodium chloride, ammonium bromide, potassium iodide, sodium iodide, ammonium iodide and others. The preferred content of such an additive is within the range of 0.5 to 900 g per one l bleach-fixer.

Other useful additives are those usually contained in a bleach-fixer as an additive, and are as follows: pH buffers such as a borate, oxalate, carbonate, phosphate, and the like; solubilizing agents such as triethanolamine and the like; acetylacetone, phosphonocarboxylic acid, polyphosphoric acid, organic phosphonic acid, oxycarboxylic acid, polycarboxylic acid, alkylamines and polyethyleneoxides; and others.

Other useful additives include various fluorescent whitening agents, defoaming agents, surface active agents, fungicides, and others. Still other useful additives are as follows: preservatives such as hydroxylamine, hydrazine, metabisulfite, bisulfurous acid adduct of aldehyde or ketone compound, and the like; organic chelating agents such as acetylacetone, phosphonocarboxylic acid, polyphosphoric acid, organic phosphonic acid, oxycarboxylic acid, dicarboxylic acid, and the like; stabilizing agents such as nitro alcohol, nitrate, and the like; solubilizing agents such as alkanolamine and the like; anti-stain agents such as organic amine and the like; other additives; organic solvents such as methanol, dimethylformamide, dimethylsulfoxide, and the like; and others.

Typical examples of bleach-fixer according to the invention

The typical examples of the invention are hereinafter described in detail, however, the scope of application of the invention is not limited only to these examples.

PREPARATION OF BLEACH-FIXERS

(1) Bleach-fixer 1 (Comparison)

| | |
|---|---|
| Ingredient (OO): ferric ammonium ethylenediamine-tetraacetate dihydride | 100 g |
| Ingredient (PP): ethylenediaminetetraacetic acid | 50 g |
| Ingredient (QQ): ammonium thiosulfate (70% aqueous solution) | 200 ml |
| Ingredient (RR): ammonium sulfite (40% aqueous solution) | 40 ml |
| Aqueous ammonia (concentration, 28%) | 8 ml |
| Water: an amount to complete one l solution | |

The materials, above, were blended and dissolved to form a solution, whose pH was adjusted to 7.0 with ammonia water or glacial acetic acid, thus a comparison bleach-fixer was prepared. This was designated "Bleach-fixer 1".

The contents of ingredients (PP) and (RR) were as follows.

Ingredient (PP): $1.70\times10^{-1}$ mol/l
Ingredient (RR): $1.26\times10^{-1}$ mol/l

(2) Bleach-fixer 2 (Comparison)

A comparison bleach-fixer was prepared in a manner identical to that of bleach=fixer 1, except that the amount of ingredient (PP), ethylenediaminetetraacetic acid, was 35 g and the amount of ingredient (RR), ammonium sulfite (40% aqueous solution) was 100 ml. This was designated "Bleach-fixer 2".

The contents of ingredients (PP) and (RR) were as follows.

Ingredient (PP): $1.19\times10^{-1}$ mol/l
Ingredient (RR): $3.10\times10^{-1}$ mol/l

(3) Bleach-fixer 3 (Comparison)

A comparison bleach-fixer was prepared in a manner identical to that of bleach-fixer 1, except that the amount of ingredient (PP), ethylenediaminetetraacetic acid, was 5 g and the amount of ingredient (RR), ammonium sulfite (40% aqueous solution) was 0.1 ml. This was designated "Bleach-fixer 3".

The contents of ingredients (PP) and (RR) were as follows.

Ingredient (PP): $1.70\times10^{-2}$ mol/l
Ingredient (RR): $3.10\times10^{-4}$ mol/l

(4) Bleach-fixer 4 (Invention)

A bleach-fixer according to the invention was prepared in a manner identical to that of bleach-fixer 1, except that the amount of ingredient (PP), ethylenediaminetetraacetic acid, was 5 g and the amount of ingredient (RR), ammonium sulfite (40% aqueous solution) was 35 ml. This was designated "Bleach-fixer 4".

The contents of ingredients (PP) and (RR) were as follows.

Ingredient (PP): $1.70\times10^{-2}$ mol/l
Ingredient (RR): $1.10\times10^{-1}$ mol/l (5) Bleach-fixer 5 (Invention)

A bleach-fixer according to the invention was prepared in a manner identical to that of bleach-fixer 1, except that five g hydroxyethyliminodiacetic acid was used as ingredient (PP) instead of ethylenediaminetetraacetic acid and that ten g formaldehyde-sulfurous acid adduct was used as ingredient (RR) instead of ammonium sulfite (40% aqueous solution). This was designated "Bleach-fixer 5".

The contents of ingredients (PP) and (RR) were as follows.

Ingredient (PP): $2.80\times10^{-2}$ mol/l

Ingredient (RR): $1.25\times10^{-1}$ mol/l (6) Bleach-fixer 6 (Invention)

A bleach-fixer according to the invention was prepared in a manner identical to that of bleach-fixer 1, except that ethylenediaminetetraacetic acid as the ingredient (PP) was not used and that the amount of ammonium sulfite (40% aqueous solution) was changed to 36 ml. This was designated "Bleach-fixer 6".

The contents of ingredients (PP) and (RR) were as follows.

Ingredient (PP): 0 mol/l

Ingredient (RR): $1.14\times10^{-1}$ mol/l (7) Bleach-fixer 7 (Invention)

A bleach-fixer according to the invention was prepared in a manner identical to that of bleach-fixer 6, except that 150 g diethylenetriaminepentaacetic acid was used as the ingredient (OO) instead of ferric ammonium ethylenediaminetraacetate dihydride. This was designated "Bleach-fixer 7".

The contents of ingredients (PP) and (RR) were as follows.

Ingredient (PP): 0 mol/l

Ingredient (RR): $1.14\times10^{-1}$ mol/l (8) Bleach-fixer 8 (Invention)

A bleach-fixer according to the invention was prepared in a manner identical to that of bleach-fixer 6, except that 150 g ferric ammonium hydroxyiminodiacetate used as the ingredient (OO) instead of ferric ammonium ethylenediaminetetraacetate dihydride. This was designated "Bleach-fixer 8".

The contents of ingredients (PP) and (RR) were as follows.

Ingredient (PP): 0 mol/l

Ingredient (RR): $1.14\times10^{-1}$ mol/l

Fabrication of containers

Container 1', container 2', container 3', container 4' and container 5' were fabricated respectively with a combination of material and method correspondingly identical to that of container 1, container 2, container' 3, container 4 and container 5 in the typical examples for color developers.

The correspondence between these containers as follows.

| |
|---|
| Container 1 (5 l) - container 1' (5.5 l) (comparison) |
| Container 2 (5 l) - container 2' (5.5 l) (comparison) |
| Container 3 (5 l) - container 3' (5.5 l) (comparison) |
| Container 4 (5 l) - container 4' (5.5 l) (invention) |

-continued

| |
|---|
| Container 5 (5 l) - container 5' (5.5 l) (invention) |

As shown by the correspondence table, above, the containers for bleach-fixer differ from those for color developer only in terms of a capacity.

<Test (1) for preservation-stability of bleach-fixers>

Seven examples of each of the above-mentioned containers 1' through 5' were fabricated, thus providing the five groups of containers. The previously mentioned bleach-fixers 1 through 7 was respectively filled into each of the seven containers per group at the rate of five l, then each inlet/outlet was sealed air-tight. Every container filled with color container was stored for two months, in a test chamber whose internal environments were set at 38° C. of temperature, 65% of relative humidity, and one atm of atomospheric pressure.

Next, using each of color developers after storage, the test to form a photograph was carried out, in compliance with the following conditions, by actually treating a silver halide photographic light-sensitive material, for color paper, which had been already exposed with a step-type exposure wedge for sensitometry, whereby the recoloration and the whiteness were examined with an obtained photograph.

The results are shown in Table 2, given later

The evaluation criteria of the recoloration and the whiteness were as follows.

Recoloration

Using an optical densitometer, a red-density was measured with each of the obtained photographs, then each photograph was subjected to red-treatment, whereby it was immersed in 5% aqueous red prussiate for five minutes, washed with water for three minutes, and dried. Subsequently, each of the obtained photographs was measured in a manner identical to that mentioned above, and the difference between two density values was determined. A red-density of a photograph, after red-treatment, being higher than that of the same photograph before the red-treatment indicates recoloration, which in turn means the photograph, before the red-treatment, has a poor recoloration. Additionally, a poor recoloration is defined as a red-density of a photograph, after the red-treatment, being more than +0.1 larger than that of the same photograph before the red-treatment.

Whiteness

With each of the obtained photographs, a minimum density was measured to inspect the occurrecce of stain. A poor whiteness is defined as a whiteness more than 0.01 larger, in terms of density, than that of a reference sample.

[Conditions to form photograph]

Silver halide photographic light-sensitive material for color photograph

"SAKURA COLOR type SIII paper" (manufactured by Konishiroku Photo Industry Co., Ltd.)

Standard treatment processes (1) Color developing (38° C., 3 min 30 sec)

(2) Bleach-fixing (38° C., 1 min 30 sec)

(3) Stabilizing (25°~35° C., 3 min)

(4) Drying (75° ~ 100° C., approx. 2 min)

| Color developer: | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 24.0 g |
| 3-methyl-4-amino-N—ethyl-N—(β-methanesulfonamide-ethyl)-aniline sulfate | 4.5 g |
| Fluorescent whitening agent (4,4'-diaminostilbenedi-sulfonic derivative) "Kaycoll PK-conc" (manufactured by Shin-Nisso Kako Co., Ltd.) | 1.0 g |
| Hydroxylamine sulfate | 3.0 g |
| 1-Hydroxyethylidene-1,1-diphosphonic acid | 0.4 g |
| Hydroxyethyliminodiacetic acid | 5.0 g |
| Magnesium chloride hexadydride | 5.0 g |
| Disodium 1,2-hydroxybenzene-3,5-disulfonate | 0.2 g |
| Water: an amount to complete one l solution | |

The materials, above, were mixed and dissolved to make a solution, which was treated with potassium hydroxide or sulfuric acid to have the pH value of 10.20.

| Stabilizer | |
|---|---|
| Ethylene glycol | 1.0 g |
| 1-hydroxylethylidene-1,1-diphosphonic acid (60% aqueous solution) | 1.0 g |
| Aqueous ammonia (25% ammonium hydride aqueous solution) | 2.0 g |
| Water: an amount to complete one l solution | |

The materials, above, were mixed and dissolved to make a solution, which was treated with sulfuric acid to have the pH value of 7.0.

<Test (2) for preservation-stability of bleach-fixers>

Bleach-fixers were stored in a manner identical to that in the test (1) for preservation-stability of bleach-fixers, except that a temperature in the test chamber was changed to 58° C. Next, using each of bleach-fixers after storage, the test to form a photograph was carried out in a manner identical to test 1, whereby the results identical to those in table 2 were obtained.

<Test (3) for preservation-stability of bleach-fixers>

Color developers were stored in a manner identical to that in the test (1) for preservation-stability of bleach-fixers, except that a temperature in the test chamber was changed to 78° C. Next, using each of color developers after storage, the test to form a photograph was carried out in a manner identical to test 1, whereby the results identical to those in table 2 were obtained.

TABLE 2

| | Color developer 1 (Comparison) | Color developer 2 (Comparison) | Color developer 3 (Comparison) | Color developer 4 (Invention) | Color developer 5 (Invention) | Color developer 6 (Invention) | Color developer 7 (Invention) | Color developer 8 (Invention) |
|---|---|---|---|---|---|---|---|---|
| Recoloration | | | | | | | | |
| Container 1' (Comparison) | Satisfactory | Satisfactory | Satisfactory* | Satisfactory | Satisfactory* | Satisfactory* | Satisfactory* | Satisfactory* |
| Container 2' (Comparison) | Satisfactory | Satisfactory | Satisfactory* | Satisfactory | Satisfactory* | Satisfactory* | Satisfactory* | Satisfactory* |
| Container 3' (Comparison) | Satisfactory | Satisfactory | Satisfactory* | Satisfactory | Satisfactory* | Satisfactory* | Satisfactory* | Satisfactory* |
| Container 4' (Invention) | Un-satisfactory | Un-satisfactory | Satisfactory* | Satisfactory | Satisfactory | Satisfactory | Satisfactory | Satisfactory |
| Container 5' (Invention) | Un-satisfactory | Un-satisfactory | Satisfactory* | Satisfactory | Satisfactory | Satisfactory | Satisfactory | Satisfactory |
| Whiteness | | | | | | | | |
| Container 1' (Comparison) | Un-satisfactory | Un-satisfactory | Un-satisfactory | Un-satisfactory | Un-satisfactory | Un-satisfactory | Un-satisfactory | Un-satisfactory |
| Container 2' (Comparison) | Un-satisfactory | Un-satisfactory | Un-satisfactory | Un-satisfactory | Un-satisfactory | Un-satisfactory | Un-satisfactory | Un-satisfactory |
| Container 3' (Comparison) | Un-satisfactory | Un-satisfactory | Un-satisfactory | Un-satisfactory | Un-satisfactory | Un-satisfactory | Un-satisfactory | Un-satisfactory |
| Container 4' (Invention) | Satisfactory | Satisfactory | Un-satisfactory | Satisfactory | Satisfactory | Satisfactory | Satisfactory | Satisfactory |
| Container 5' (Invention) | Satisfactory | Satisfactory | Un-satisfactory | Satisfactory | Satisfactory | Satisfactory | Satisfactory | Satisfactory |

Note:
"Satisfactory*" means precipitation was found.

As can be understood from the results in table 2, the use of the method according to the invention can stably store a bleach-fixer for a long period, without jeopardizing its photographic performance. As a result, a bleach-fixing process is satisfactorily carried out even with a stored bleach-fixer.

In contrast, in the case where a bleach-fixer is stored in any of the comparison containers 1' through 3', a high oxygen-permeation coefficient of a container results in decomposition of sulfite and occurrence of precipitation, and accordingly, the whiteness of an obtained photograph is jeopardized.

Additionally, when the stored comparison bleach-fixer 1 is used for bleach-fixing, a high content of the ingredient (PP), aminopolycarboxylic acid, in the bleach-fixer 1 causes the poor recoloration which is considered to be triggered by the accumulation of ferrous aminopolycarboxylate, or a reduction product of ferric aminopolycarboxylate.

When the stored comparison bleach-fixer 2 is used for bleach-fixing, a high content of the ingredient (RR), sulfite, in the bleach-fixer 2 causes ferric aminopolycarboxylate to be reduced by the sulfite, resulting in the occurrence of poor recoloration.

When the stored comparison bleach-fixer 3 is used for bleach-fixing, a low content of the ingredient (RR), sulfite, in the bleach-fixer 3 causes the precipitation, which is considered to be the precipitated sulfur due to the decomposed ingredient (QQ), thiosulfate, and accordingly, the whiteness of obtained photograph is remarkably jeopardized.

What is claimed is:

1. A method of storing photographic processing solution characterized in that storing a photographic processing solution selected from the group consisting of a liquid color developer containing ingredients given below and a liquid bleach-fixer containing ingredients given below in an container made of plastic material of which oxygen permeation coefficient is 0 to 50 ml/($m^2$·atm·day) under temperature at 20° C. and relative humidity at 60%;

[Developer]

(AA) an aromatic primary amine color developing agent;

(BB) an alkyl substituted hydroxylamine compound represented by the general formula [I]; [I]

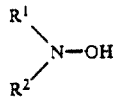

(wherein $R^1$ and $R^2$ are independently selected from the group consisting of a hydrogen atom and a substituted or unsubstituted alkyl group having 1 to 3 carbon atoms, provided that at least one of $R^1$ and $R^2$ is an unsubstituted alkyl group having 1 to 3 carbon atoms and that $R^1$ and $R^2$ may be combined with each other to form a ring) and (CC) an alkaline ingredient for making pH of said liquid coor developer not less 9.5;

[Bleach-fixer]

(OO) a ferric aminopolycarboxylate, (PP) an aminopolycarboxylic acid at a quantity of 0 to $1\times10^{-3}$ mol per liter of said liquid bleach-fixer, (QQ) a thiosulfate and (RR) a sulfite at a quantity of $1\times10^{-3}$ to $2\times10^{-1}$ mol per liter of said liquid bleach-fixer.

2. The method of claim 1, wherein said oxygen permeation coefficient is 0 to 25 ml/($m^2$·atm·day) under temperature at 20° C. and relative humidity at 60%.

3. The method of claim 1, wherein said aromatic primary amine color developing agent is a p-phenylenediamine compound having at least one water-soluble group in the amino group thereof.

4. The method of claim 3, wherein said water-soluble group is selected from the group consisting of a—$(CH_2)$n—$CH_2OH$ group, a—$(CH_2)$m—$NHSO_2$—$(CH_2)$n—$CH_3$ group, a—$(CH_2)$m—O—$(CH_2)$n—$CH_3$ group, a—$(CH_2CH_2O)$n$CmH_{2m+1}$ group, —COOH group and —$SO_3H$ group.

5. The method of claim 1, wherein said alkyl substituted hydroxylamine compound is selected from the group consisting of diethylhydroxylamine, dimethylhydroxylamine, mono-ethylhydroxylamine, mono-n-propylhydroxylamine, ethyl-methoxyethylhydroxylamine, morpholinohydroxylamine and di-methoxyethylhydroxylamine.

6. The method of claim 1, wherein said alkyl-substituted hydroxylamine compound is contained at a quantity of 0.5 to 30 g per liter oi of said liquid color developer.

7. The method of claim 7, wherein said alkyl-substituted hydroxylamine compound is contained at a quantity of 1 to 15 g per liter of of said liquid color developer.

8. The method of claim 1, wherein pH of said liquid color developer is 9.6 to 13.

9. The method of claim 8, wherein pH of said liquid color developer is 9.8 to 12.5.

10. The method of claim 1, wherein aminopolycarboxylic acid to form said ferric aminopolycarboxylate is selected from the group consisting of diethylenetriaminepentaacetic acid, cyclohexanediaminetetraacetic acid, hydroxyethyliminodiacetic acid, triethylenetetraminehexaacetic acid, ehtylenediaminetetraacetic acid, 1,2-diaminopropanetetraacetic acid, methyliminodiacetic acid, glycolehterdiaminetetraacetic acid, nitrilotripropianic acid and 1,3-diaminopropanetetraacetic acid.

11. The method of claim 10, wherein said aminopolycarboxylic acid to form said ferric aminopolycarboxylate is selected from the group consisting of diethylenetriaminepentaacetic acid, methyliminodiacetic acid and 1,3-diaminopropanetetraacetic acid.

12. The method of claim 1, wherein said aminopolycarboxylic acid contained in said liquid bleach-fixer is 0 to $5\times10^{-2}$ mol/liter.

13. The method of claim 12, wherein said aminopolycarboxylic acid contained in said liquid bleach-fixer is 0 to $2\times10^{-2}$ mol/liter.

14. The method of claim 1, wherein said sulfite is contained in said liquid bleach-fixer at a quantity of $1.0\times10^{-2}$ to $1.5\times10^{-1}$ mol/liter.

15. The method of claim 1, wherein pH of said liquid bleach-fixer is 4 to 9.

16. The method of claim 15, wherein pH of said liquid bleach-fixer is 5.0 to 8.5.

17. The method of claim 1, wherein said plastic material is selected from the group consisting of a plastic sheet material made of a polyvinylidene chloride, a nylon, a saponified ethylene-vinylacetate copolymer or a polyvinylalcohol and a laminated sheet material made of a polyvinylidene chloride, a nylon, a saponified ethylenevinylacetate copolymer or a polyvinylalcohol with a metal sheet by lamination or by vapor deposition process.

18. The method of claim 17, wherein material to form said plastic material is selected from the group consisting of a polyvinylidene chloride, a nylon, and a saponified ethylenevinylacetate copolymer.

19. The method of claim 17, wherein said plastic material has a thickness of 5 to 1500 μm.

20. The method of claim 19, wherein said plastic material has a thickness of 10 to 500 μm.

21. The method of claim 20, wherein said oxygen permeation coefficient of said plastic material is 0 to 25 ml/($m^2$·atm·day) under temperature at 20° C. and relative humidity at 60%.

22. The method of claim 4, wherein said liquid color developer contains an alkyl-substituted hydroxylamine compound selected from the group consisting of diethylhydroxylamine, dimethylhydroxylamine, monoethylhydroxylamine, mono-n-propylhydroxylamine, ethymethoxyethylhydroxylamine, morpholinohydroxylamine and di-methoxyethylhydroxylamine.

23. The method of claim 22, wherein said alkyl-substituted hydroxylamine compound hydroxylamine compound is contained at a quantity of 0.5 to 30 g per liter of said liquid color developer.

24. The method of claim 23, wherein pH of said liquid color developer is 9.8 to 12.5.

25. The method of claim 24, wherein material to form said plastic material is selected from the group consisting of a polyvinylidene chloride, a nylon and a saponified ethylenevinylacetate copolymer, the oxygen permeation coefficient of said plastic material being 0 to 25 ml/($m^2$·atm·day) under temperature at 20° C. and relative humidity at 60%.

26. The method of claim 25, wherein said plastic material has a thickness of 10 to 500 μm.

27. The method of claim 10, wherein said aminopolycarboxylic acid contained in said liquid bleach-fixer is 0 to $5\times10^{-2}$ mol/liter.

28. The method of claim 28, wherein said liquid bleach-fixer is contains said sulfite at a quantity of $1.0\times10^{-2}$ to $1.5\times10^{-1}$ mol/liter.

29. The method of claim 28, wherein pH of said liquid bleach-fixer is 5.0 to 8.5.

30. The method of claim 29, wherein material to form said plastic material is selected from the group consistin9 of a polyvinylidene chloride, a nylon and a saponified ethylenevinylacetate copolymer, the oxygen permeation coefficient of said plastic material being 0 to 25 ml/($m^2$·atm·day) under temperature at 20° C. and relative humidity at 60%.

31. The method of claim 30, wherein said plastic material has a thickness of 10 to 500 μm.

* * * * *